United States Patent [19]

Williams

[11] Patent Number: 4,972,791

[45] Date of Patent: Nov. 27, 1990

[54] BOAT PROTECTION DEVICE

[76] Inventor: Gary P. Williams, 38 W. Prince Rd., #29, Tucson, Ariz. 85705

[21] Appl. No.: 515,456

[22] Filed: Apr. 27, 1990

[51] Int. Cl.[5] ..... B63B 59/02

[52] U.S. Cl. ..... 114/219; 405/1; 114/343; 114/361

[58] Field of Search ..... 114/219, 343, 361, 364, 114/381; 405/1–7; 280/414.1–414.3

[56] References Cited

U.S. PATENT DOCUMENTS

| | | | |
|---|---|---|---|
| 2,503,535 | 4/1950 | Yarbrough | 280/414.1 |
| 3,055,022 | 9/1962 | Vallquist | 405/1 X |
| 3,528,095 | 9/1970 | Gudmundson | 280/414.1 |
| 3,579,996 | 5/1971 | Edson | 405/1 |
| 4,909,172 | 3/1990 | Hamby | 114/219 |

*Primary Examiner*—Joseph F. Peters, Jr.
*Assistant Examiner*—Edwin L. Swinehart
*Attorney, Agent, or Firm*—H. Jay Spiegel

[57] ABSTRACT

The present invention relates to an improved boat protection device. The boat protection device includes a pair of plates that are pivotally attached together. The boat protection device plates may have attached thereto a plurality of attachment lines which facilitate securing the boat protection device to the underside of a boat. Each plate has a plurality of wedges on the bottom surface thereof. The wedges are designed to engage a ground surface, thereby configuring the plates in a V-shape to cradle and support a boat on a ground surface or in shallow water. The plates may also have a protective covering thereon to further protect the underside of the beached or moored boat.

7 Claims, 3 Drawing Sheets

BOAT PROTECTION DEVICE

BACKGROUND OF THE INVENTION

The present invention relates to a boat protection device. In the prior art, devices designed to protect the hulls or bottom surfaces of a boat are known. However, Applicant is unaware of any prior art that includes all of the features of the present invention. The following prior art is known to Applicant:

U.S. Pat. No. 4,667,619 to Nishida discloses a flexible bottom protector for a small boat designed to be integrally attached to the hull of the boat to protect the boat from damage. The teachings of Nishida are different from those of the present invention in that Nishida does not disclose a boat protection device capable of having a V-shaped configuration and designed to support and protect a boat while docked or moored in shallow water.

U.S. Pat. No. 4,803,942 to Dren et al. discloses a boat and hull protector comprising a flexible mat having a plurality of ribs on the bottom surface thereof to facilitate engaging a beach or the like and a pair of support means on the top surface thereof to cradle and hold a boat during beaching. Of course, this is different from the teachings of the present invention in that Dren et al. do not teach or fairly suggest a boat protection device comprising a two-piece assembly, each piece having a plurality of wedges attached to the bottom surface thereof to provide support for a boat when moored or beached.

SUMMARY OF THE INVENTION

The present invention relates to a boat protection device. The present invention includes the following interrelated aspects and features:

(A) In a first aspect, the present invention includes a pair of plates that are pivotally attached together. The plates may have a rectangular or square configuration.

(B) The bottom surface of each of the plates has attached thereto a plurality of wedges. The wedges are aligned perpendicular to the axis of the pivotal attachment between the two plates. The wedges when contacting a ground surface configure the two plates in a V-shape such that the two plates may cradle and support a boat while resting on the boat protection device.

(C) Each of the plates may have a resilient covering thereon to further protect the bottom surface of a boat from damage by scraping or rubbing against the boat protection device.

(D) Each plate may include means to attach the boat protection device to the underside of a boat. The attachment means may include lines that are attached on one end thereof to a portion of the boat protection device with the other end being adapted to attach to a portion of a boat.

Accordingly, it is a first object of the present invention to provide an improved boat protection device.

It is a further object of the present invention to provide a boat protection device that may be folded and easily stored when not in use.

It is a yet further object of the present invention to provide a boat protection device that is designed to protect a boat against damage while moored or beached on the ground or in shallow water.

It is still yet a further object of the present invention to provide a boat protection device that may be deployed prior to a boat reaching shallow water or a beach, and positioned underneath a boat surface to provide protection against damage from rocks or the like.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
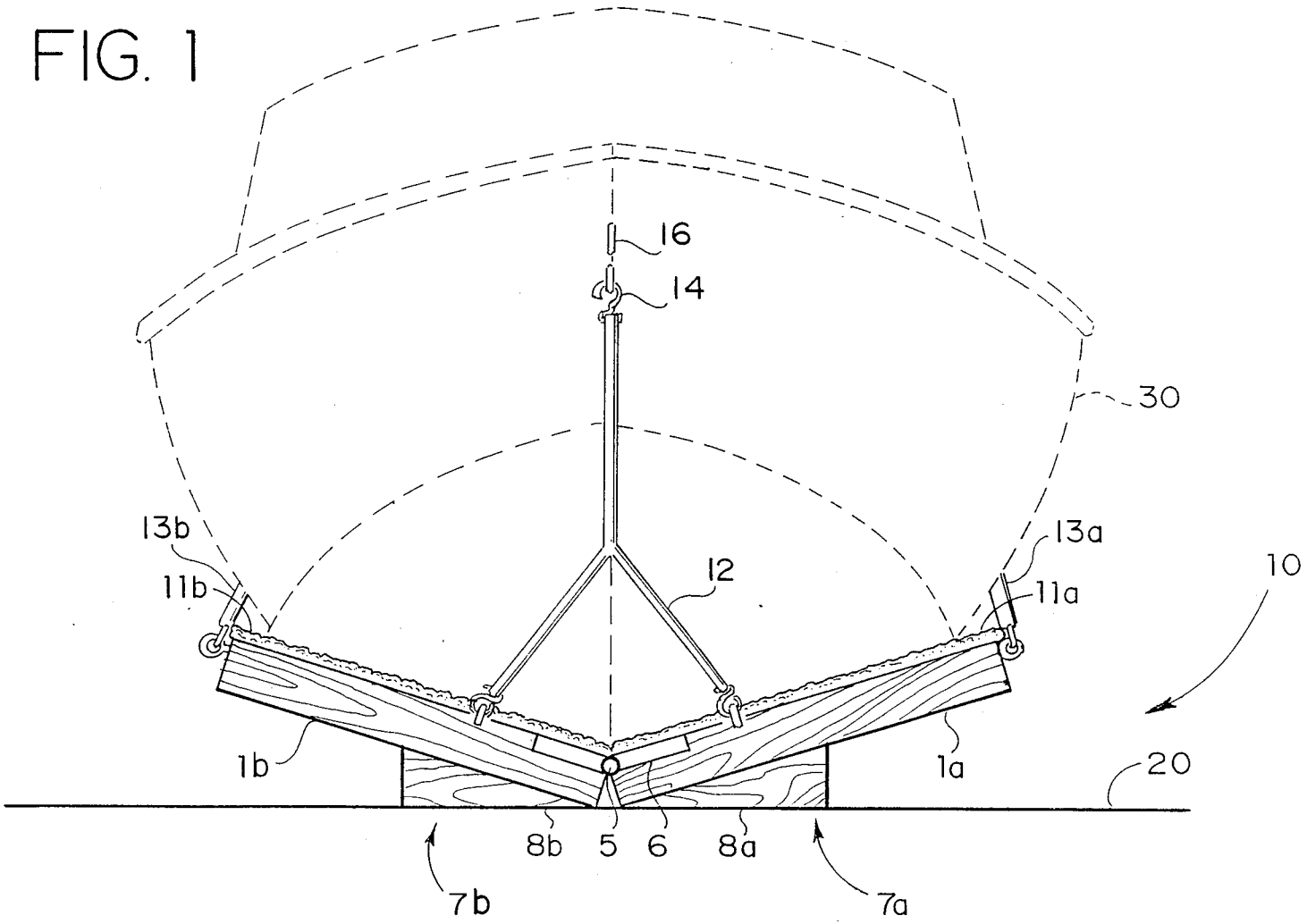
FIG. 1 shows a side view of the boat protection device in an exemplary use.

With reference to FIG. 1 firstly, the boat protection device is generally designated by the reference numeral 10 and is seen to include a first plate 1*a*, a second plate 1*b* and a hinge means 5 pivotally attaching the plates 1*a* and 1*b* together. On the bottom surface of each of the plates 1*a* and 1*b* are a plurality of wedges designated by the reference numerals 7*a* and 7*b*, respectively. The wedges 7*a* and 7*b* have a bottom surface 8*a* and 8*b*, respectively, which engage the surface of the ground 20. The wedges 7*a* and 7*b* may be attached to the plates by any conventional means.

Each of the plates 1*a* and 1*b* may have attached to the top surfaces thereof a resilient covering 11*a* and 11*b*, respectively, which further protects the surface of the boat 30 from damage. Furthermore, the hinge means 5 may have the hinge plates 6 recessed within the plates 1*a* and 1*b* to provide a smooth top surface for attaching the protective covering 11*a* and 11*b* thereto.

With reference still to FIG. 1, each of the plates 1*a* and 1*b* may have a line 12 attached at one end thereto. The line 12 may have attached at the other end a hook 14 which may attach to the bow eye 16 of a boat.

Figure 2:
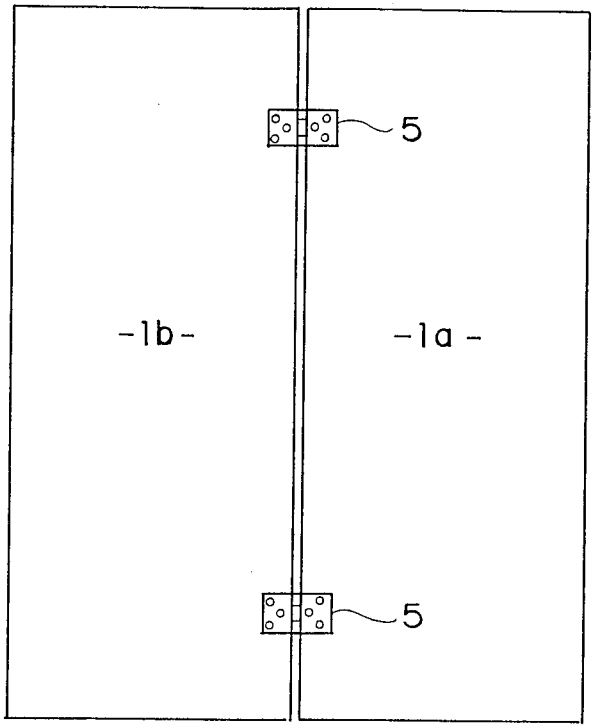
FIG. 2 shows a top view of the boat protection device with the protective covering and attaching lines removed.

With reference to FIG. 2, a top view of the boat protection device is shown without the protective covering and attaching lines and more clearly illustrates the plurality of hinges 5 used to pivotally attach the two plates 1*a* and 1*b* together.

Figure 3:
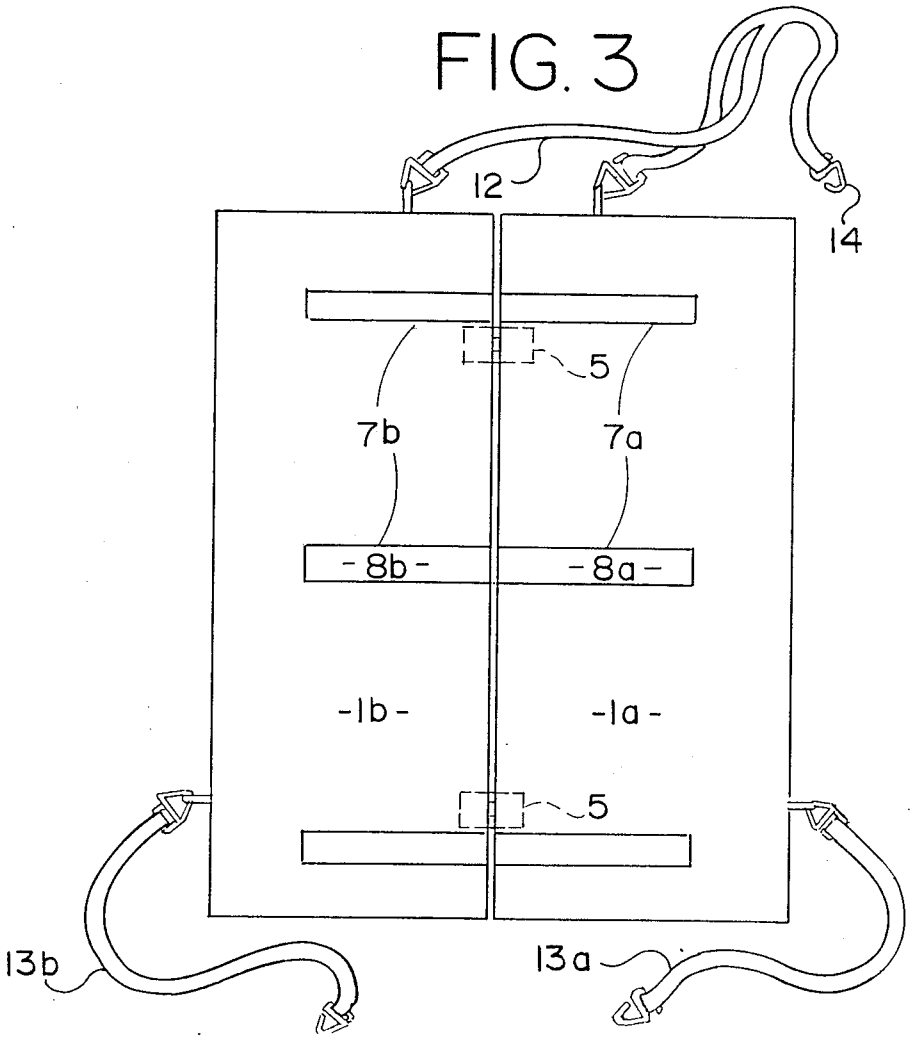
FIG. 3 shows a bottom view of the boat protection device.

With reference to FIG. 3, a bottom view of the boat protection device is shown to more clearly illustrate the spacing of the wedges 7*a* and 7*b*. As can be seen from the drawing, three sets of wedges may be attached at spaced intervals along the plates 1*a* and 1*b*, the wedges being attached transversely to the plates and each wedge having a length shorter than the overall thickness of the plate that the wedge is attached thereto. Of course, any number of wedges may be attached to the plates and the spacing between the wedges may vary. Furthermore, the length of the wedges may also vary in relation to the width of the plates.

Figure 4:
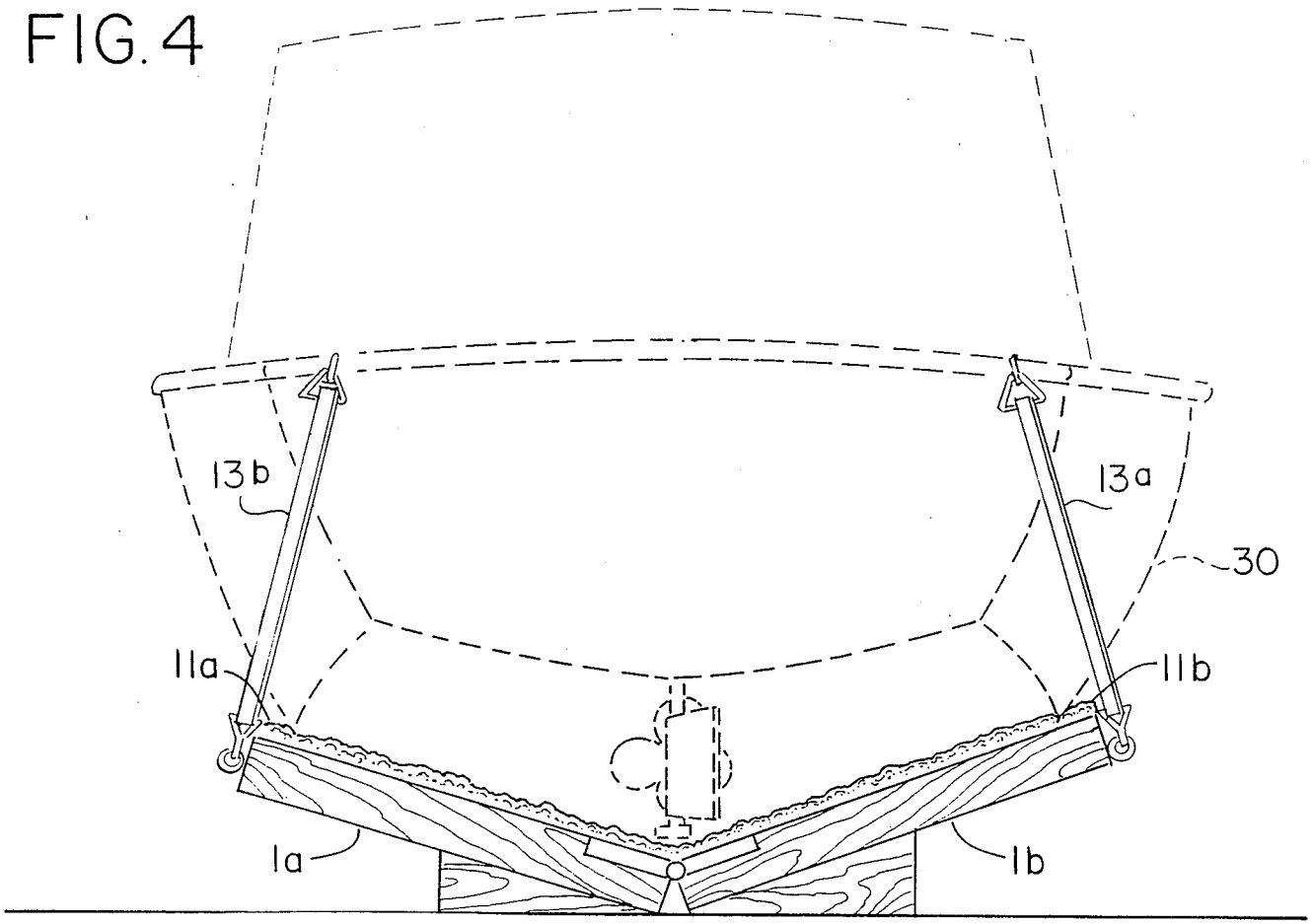
FIG. 4 shows a rear view of the boat protection device in an exemplary use.

With reference to FIGS. 3 and 4, the forward attaching line 12 and two rearward attaching lines 13*a* and 13*b* are shown attached to the boat 30. The rearward attaching lines 13*a* and 13*b* may secure the boat protection device to a boat by running the length of the boat and attaching to stern cleats or U-bolts of the boat 30. Although not depicted in the drawings, the attaching lines 13*a* and 13*b*, in addition to being secured to the edges of the plates 1*a* and 1*b*, respectively, may also be attached to a wedge on each plate for further stability. Of course, the attaching lines may be connected to other portions of the boat protection device such as the wedges 8*a* and 8*b*. The length of the attaching lines may be adjustable such that the boat protection device may be attached to different sized boats.

The attaching lines may be attached to the boat protection device in any conventional manner. In addition, any conventional means may be used to facilitate attachment of the lines to a boat or portion thereof, such as marine hooks, cavals or the like. The line may be made out of polyethylene or other known types of materials used in marine applications.

The materials used in the boat protection device may be any materials that are appropriate for marine conditions. A preferred material for the plates and wedges would be wood with the protective covering comprising a resilient material such as a synthetic fiber like nylon. The hinge 5 may be made of a brass or other corrosion resistant alloy. Additionally, the hinge means 5 may be substituted with other pivoting means to facilitate the pivotal attachment of the two plates together. For example, a piano hinge may also be utilized in place of the hinge means 5.

The boat protection device may be made in any dimensions. Of course, the dimensions may be related to the size of the boat intended for use with the boat protection device. An exemplary set of dimensions would include the plates being 1 inch thick, 1 foot wide by 3 feet in length with the wedges being 8 inches in length, 2 inches wide and 4 inches in height at the thickest edge portion.

The boat protection device provides many improvements over other prior art devices. The pivotal attachment of the two plates provides portability and ease of storage when the device is not in use. The device may be deployed from storage on the boat and positioned on the front underside of the boat prior to the boat being beached on dry ground or moored in shallow water. The boat protection device can be put in place by a single occupant of the boat, prior to reaching the beach or shallow water by lowering the boat protection device in the water and securing the attachment lines to the boat. The boat protection device may be installed before the boat enters shallow water as well as while in shallow water, for the protection of the boat bottom. Once the boat has cleared shallow water and entered into deep water, the boat protection device may be removed, folded and stored on the boat until reaching shallow water or a beach again.

As such, an invention has been disclosed in terms of a preferred embodiment thereof which fulfills each and every one of the objects of the invention as set forth hereinabove and provides a new and improved boat protection device of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A boat protection device for protecting a boat surface from damage comprising:

(a) a first plate having a top and bottom surface, said first plate having a plurality of first wedges attached to said bottom surface at spaced intervals thereon;

(b) a second plate having a top and bottom surface, said second plate having a plurality of second wedges attached to said bottom surface of said second plate at spaced intervals thereon;

(c) a pivoting means connected to each said first and said second plate; and (d) a plurality of attachment lines, each said attachment line being attached at one end thereof to a portion of said boat protection device, said attachment lines being adapted to attach to a boat and position said boat protection device adjacent a said boat surface for protection thereof.

2. The invention of claim 1, further comprising a protective covering attached to said top surface of each of said first plate and said second plate, said protective covering further protecting a surface of a boat from damage.

3. The invention of claim 1, wherein said pivoting means comprises a plurality of hinges.

4. The invention of claim 1, wherein said first plate, said second plate, each of said first wedges and each of said second wedges are wood.

5. The invention of claim 2, wherein said protective covering is a resilient synthetic fabric.

6. The invention of claim 1, wherein said first and said second plates are rectangular in shape and each of said first wedges and each of said second wedges are attached transversely to a respective said first plate and said second plate.

7. The invention of claim 1, wherein said plurality of attachment lines includes a first attachment line being adapted to attach to a bow portion of a boat and a pair of second attachment lines, each said second attachment line being adapted to attach to a stern portion of a boat.

* * * * *